US009031422B2

(12) United States Patent
Fujita

(10) Patent No.: US 9,031,422 B2
(45) Date of Patent: May 12, 2015

(54) CONVEYING APPARATUS AND IMAGE FORMING APPARATUS

(75) Inventor: Naohisa Fujita, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 279 days.

(21) Appl. No.: 13/092,514

(22) Filed: Apr. 22, 2011

(65) Prior Publication Data

US 2012/0076513 A1 Mar. 29, 2012

(30) Foreign Application Priority Data

Sep. 24, 2010 (JP) ..... 2010-214033

(51) Int. Cl.
*G03G 15/00* (2006.01)
*G03G 21/16* (2006.01)

(52) U.S. Cl.
CPC ..... *G03G 21/1638* (2013.01); *G03G 2221/169* (2013.01)

(58) Field of Classification Search
USPC ..... 400/691, 692, 693; 399/388, 389, 66, 399/88, 89, 90, 11, 16, 17, 18, 21
See application file for complete search history.

(56) References Cited

U.S. PATENT DOCUMENTS 6,144,811 A * 11/2000 Ohori et al. ..... 399/9
6,474,883 B1 * 11/2002 Kawakami et al. ..... 400/613
6,628,903 B1 9/2003 Ohori et al.
6,898,383 B2 5/2005 Ohori et al.
8,011,844 B2 * 9/2011 Yada et al. ..... 400/613
8,328,189 B2 * 12/2012 Okamura ..... 271/258.05
2002/0041775 A1 * 4/2002 Ishii ..... 399/124
2004/0037588 A1 * 2/2004 Iida ..... 399/124
2005/0201765 A1 * 9/2005 Shinga ..... 399/16
2006/0018672 A1 * 1/2006 Asaba ..... 399/21
2006/0284362 A1 * 12/2006 Kanome ..... 271/10.01
2007/0077085 A1 * 4/2007 Kitamura et al. ..... 399/110

(Continued)

FOREIGN PATENT DOCUMENTS

CN 1236122 A 11/1999
CN 102198896 A 9/2011

(Continued)

OTHER PUBLICATIONS

Japanese Office Action dated Apr. 30, 2014 and issued in corresponding Japanese Patent Application No. 2010-214033.

(Continued)

*Primary Examiner* — Matthew G Marini
*Assistant Examiner* — Quang X Nguyen
(74) *Attorney, Agent, or Firm* — Sughrue Mion, PLLC

(57) ABSTRACT

A conveying apparatus or an image forming apparatus includes: a housing including an opening and closing member that can be opened and closed; a conveying path that conveys an object to be conveyed, at least a part of the conveying path being provided adjacent to an inner side of the opening and closing member; a first detector that detects whether the object is present in a predetermined region and outputs a detection signal corresponding to a result of the detection; and an interlocking mechanism that causes, when the opening and closing member is opened, the first detector to change at least one of a position and a structure of the first detector in mechanically association with movement of opening of the opening and closing member, and to output a detection signal which is the same as a detection signal output when the object is present in the predetermined region.

7 Claims, 16 Drawing Sheets

(56) References Cited

U.S. PATENT DOCUMENTS

| | | | | |
|---|---|---|---|---|
| 2007/0217839 | A1* | 9/2007 | Moteki et al. | 399/329 |
| 2007/0253756 | A1* | 11/2007 | Uehara | 399/322 |
| 2009/0226190 | A1* | 9/2009 | Asaba | 399/16 |
| 2010/0329737 | A1* | 12/2010 | Koga et al. | 399/124 |
| 2011/0158729 | A1* | 6/2011 | Lee | 400/578 |

FOREIGN PATENT DOCUMENTS

| | | | | |
|---|---|---|---|---|
| JP | 02-248964 | A | | 10/1990 |
| JP | 06-273986 | A | | 9/1994 |
| JP | 11-119494 | A | | 4/1999 |
| JP | 2006-227464 | A | | 8/2006 |
| JP | 2009-116266 | A | | 5/2009 |
| JP | 2011017835 | A | * | 1/2011 |

OTHER PUBLICATIONS

Communication dated Dec. 18, 2014, issued by the State Intellectual Property Office of the People's Republic of China in counterpart Application No. 201110162224.9.

* cited by examiner

CONVEYING APPARATUS AND IMAGE FORMING APPARATUS

CROSS-REFERENCE TO RELATED APPLICATION

This application is based on and claims priority under 35 USC 119 from Japanese Patent Application No. 2010-214033, filed Sep. 24, 2010.

BACKGROUND (i) Technical Field

The present invention relates to a conveying apparatus and an image forming apparatus.

(ii) Related Art

There is known a technique concerning an image forming apparatus including a cover provided to be capable of opening and closing in an apparatus main body, a detachable member detachably inserted into the apparatus main body, a detection switch that detects the attachment of the detachable member to the apparatus main body, and an interlocking member that acts by force in a direction for closing the cover in association with an attaching operation of the detachable member. In the technique, it needs only the attaching operation of the detachable member to the apparatus main body in order to close the cover automatically by action of the interlocking member, which makes it possible to omit an interlocking switch that detects whether the cover is opened or closed.

SUMMARY

A conveying apparatus according to claim 1 includes:

a housing including an opening and closing member that can be opened and closed;

a conveying path that conveys an object to be conveyed, at least a part of the conveying path being provided adjacent to an inner side of the opening and closing member;

a first detector that detects whether the object is present in a predetermined region on the conveying path and outputs a detection signal corresponding to a result of the detection; and an interlocking mechanism that causes, when the opening and closing member is opened, the first detector to change at least one of a position and a structure of the first detector in mechanically association with movement of opening of the opening and closing member, and to output a detection signal which is the same as a detection signal output when the object is present in the predetermined region on the conveying path.

BRIEF DESCRIPTION OF THE DRAWINGS

Exemplary embodiments of the present invention will be described in detail based on the following figures, wherein.

DETAILED DESCRIPTION

An exemplary embodiment of an image forming apparatus of the present invention is explained below.

Figure 1:
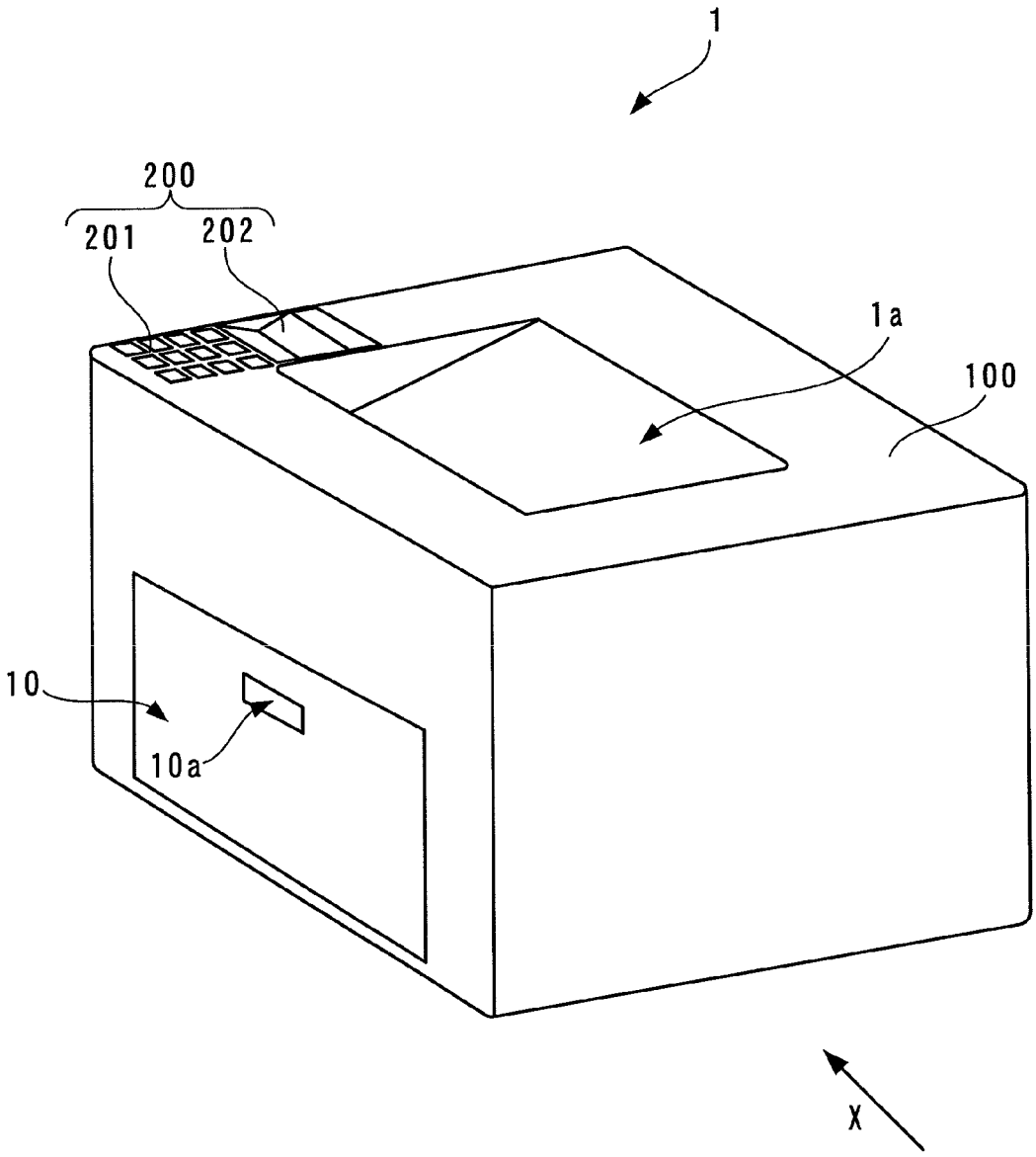
FIG. 1 is an external perspective view of a printer.

FIG. 1 is an external perspective view of a printer. This printer 1 is a first exemplary embodiment common to a conveying apparatus of the present invention and an image forming apparatus of the present invention.

The printer 1 shown in FIG. 1 is a full-color printer of an electrophotographic system. The printer 1 includes a housing 100. As explained in detail later, image forming units that form images with color toners of four colors Y (yellow), M (magenta), C (cyan), and K (Black) on a recording medium and a fixing device that fixes the toner images on the recording medium are stored in the housing 100. The housing 100 is equivalent to an example of a housing in the present invention.

An opening and closing member 10 forming a part of the housing is provided on one of the four side surfaces of the housing 100. The opening and closing member 10 is provided in a position opposed to a part of a conveying path L (see FIG. 2) on which the recording medium is conveyed. When the opening and closing member 10 is opened, a part of the conveying path L is exposed. A user opens the opening and closing member 10 by pulling a knob 10*a* to the user's side. The opening and closing member 10 is equivalent to an example of an opening and closing member in the present invention.

A hollow 1*a* is provided on the upper surface of the housing 100. The recording medium having the toner images fixed thereon is discharged to the hollow 1*a*.

An operation/display panel 200 including an operation panel 201 operated by the user and a display panel 202 on which a message is displayed is provided on the upper surface of the housing 100. The user operates the operation panel 201 to give various instructions concerning the number of prints and image expansion and reduction to the printer 1. Currently-set print conditions, an error message to the user, and the like are displayed on the display panel 202.

Figure 2:
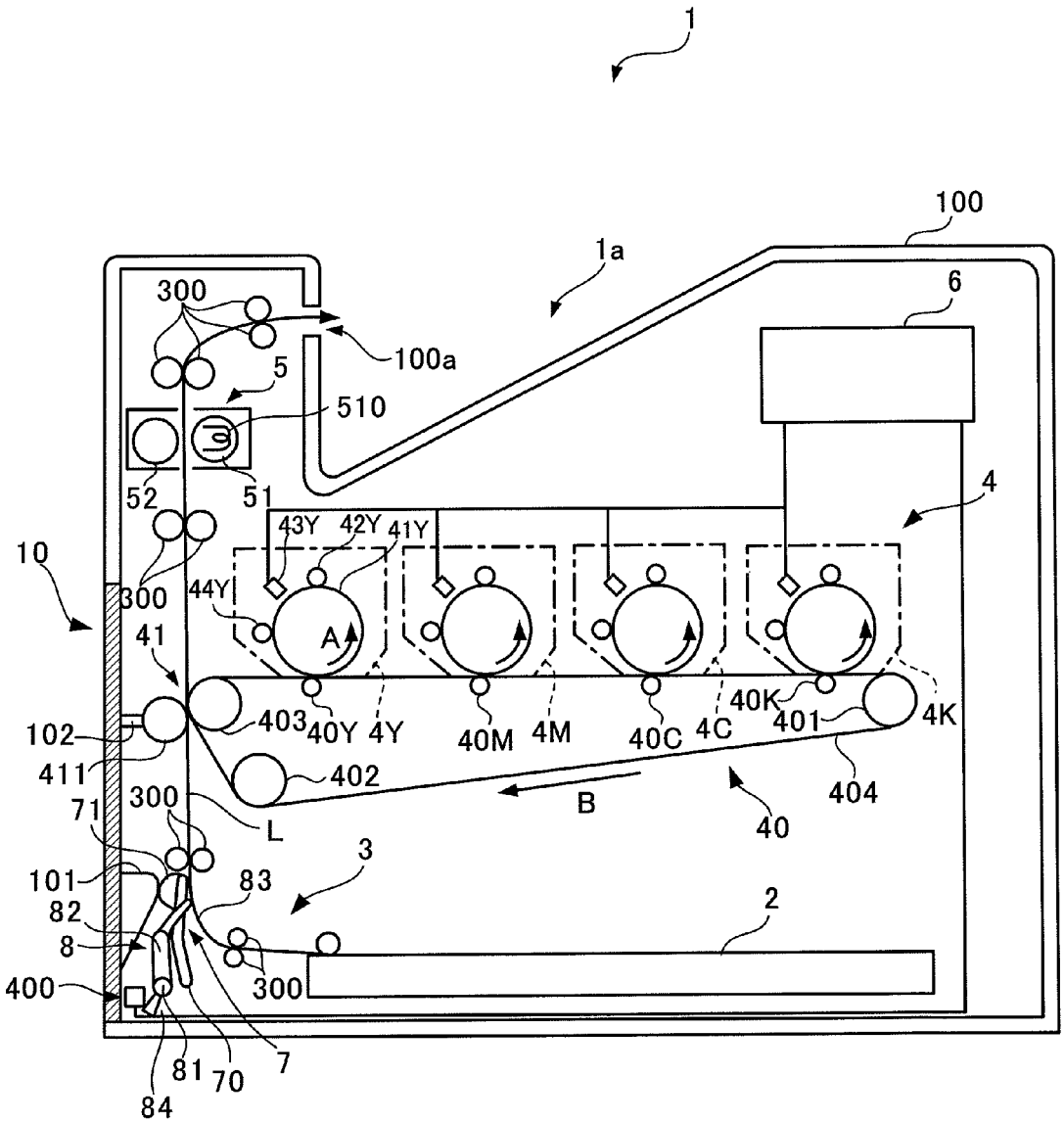
FIG. 2 is a perspective view from a side of the printer.

FIG. 2 is a perspective view from a side of the printer.

A perspective view of the printer 1 viewed in a direction of an arrow X shown in FIG. 1 is shown in FIG. 2. A discharge port 100*a*, for discharging the recording medium having the toner images fixed thereon, provided in the hollow 1*a* on the upper surface of the housing 100 is shown in FIG. 2. The opening and closing member 10 forming a part of the housing 100 is shown on the left side of FIG. 2.

The printer 1 includes a media cassette 2 at the bottom of the housing 100. A media drawing-out section 3 is provided on the left side of the media cassette 2.

Recording media are stacked and stored in the media cassette 2. The media drawing-out section 3 draws out the recording medium from the media cassette 2 one by one and feeds the drawn-out recording medium into the conveying path L. The conveying path L is disposed along the inner side of the opening and closing member 10. Plural conveying roller pairs 300 are provided along the conveying path L. The recording medium fed into the conveying path L by the media drawing-out section 3 is conveyed along the conveying path L from a lower part to an upper part in FIG. 2 by the plural conveying roller pairs 300. The conveying path L is equivalent to an example of a conveying path in the present invention.

The printer 1 includes an image forming unit 4 above the media cassette 2. The image forming unit 4 forms a toner image as explained later. The image forming unit 4 transfers the toner image onto the recording medium being conveyed on the conveying path L.

The printer 1 includes a fixing device 5 before the discharge port 100*a*. The fixing device 5 includes a heating roll 51 and a pressing roll 52. A halogen lamp 510 serving as a heat generating source is incorporated on the inside of the heating roll 51.

The recording medium having the image transferred on the surface thereof by the image forming unit 4 is heated and pressed by the fixing device 5. The toner image on the surface of the recording medium is fixed on the surface. Thereafter, the recording medium is discharged from the discharge port 100*a* to the hollow 1*a*.

The formation and the transfer of a toner image in the image forming unit 4 are explained below.

The image forming unit 4 includes four image forming sections 4Y, 4M, 4C, and 4K, a primary transfer section 40, and a secondary transfer section 41.

The four image forming sections 4Y, 4M, 4C, and 4K respectively form toner images of four colors Y (yellow), M (magenta), C (cyan), and K (black).

The primary transfer section 40 includes an intermediate transfer belt 404. The primary transfer section 40 sequentially lays the color toner images, which are formed by the four image forming sections 4Y, 4M, 4C, and 4K, on the intermediate transfer belt 404 one on top of another and transfers (primarily transfers) the color toner images.

The image forming sections 4Y, 4M, 4C, and 4K are arranged in a row in order of yellow (Y), magenta (M), cyan (C), and black (K) from an upstream side in a circulating moving direction (an arrow B direction) of the intermediate transfer belt 404. The image forming sections 4Y, 4M, 4C, and 4K have the same configuration except that colors of toners in use are different. The image forming sections 4Y, 4M, 4C, and 4K are represented by the image forming section 4Y for yellow. Components of the image forming section 4Y are explained below with reference signs for the components affixed with Y.

The image forming section 4Y includes a photosensitive roll 41Y. The photosensitive roll 41Y is a roll that rotates in an arrow A direction and extends in a direction perpendicular to FIG. 2. A charging roll 42Y is provided above the photosensitive roll 41Y. The charging roll 42Y rotates in contact with and following the photosensitive roll 41Y and applies charges to the surface of the photosensitive roll 41Y. An exposing device 43Y is provided obliquely above on the left of the charging roll 42Y.

The printer 1 includes a control section 6 shown in an upper part on the right side of FIG. 2. The control section 6 controls an operation of each functional section in the printer 1. The control section 6 receives image data transmitted from the outside and decomposes the image data into image data for colors Y, M, C, and K. The control section 6 transmits the image data for the colors to corresponding exposing devices for the colors.

An exposing device 43Y receives the image data for yellow and exposes the surface of the photosensitive roll 41Y to light according to the image data. Consequently, an electrostatic latent image corresponding to the transmitted image data is formed on the surface of the photosensitive roll 41Y. A developing roll 44Y is provided on the left of the photosensitive roll 41Y. The developing roll 44Y rotates while holding the charged Y toner on the surface thereof. A voltage is applied to the developing roll 44Y. An electric field is generated between the electrostatic latent image formed on the surface of the photosensitive roll 41Y and the developing roll 44Y. Therefore, the developing roll 44Y rotates while holding the charged toner, whereby the charged toner shifts to the electrostatic latent image side and the electrostatic latent image is developed with the toner. Toner images formed on the surfaces of the photosensitive rolls are transferred onto the surface of the intermediate transfer belt 404 by the primary transfer section 40.

The intermediate transfer belt 404, which is a component of the primary transfer section 40, is laid over a driving roll 401, a tension roll 402, and a backup roll 403, and circulates in the arrow B direction. The driving roll 401 is driven by a motor (not shown) and circulates the intermediate transfer belt 404 at speed set in advance. The tension roll 402 applies fixed tension to the intermediate transfer belt 404. The backup roll 403 is also a component of the secondary transfer section 41 and is opposed to a secondary transfer roll 411 across the intermediate transfer belt 404.

The primary transfer section 40 includes primary transfer rolls 40Y, 40M, 40C, and 40K arranged to be opposed to the photosensitive rolls across the intermediate transfer belt 404. The primary transfer rolls 40Y, 40M, 40C, and 40K hold the intermediate transfer belt 404 between the primary transfer rolls and the photosensitive rolls. A voltage having polarity opposite to charging polarity of the toners is applied to the primary transfer rolls. Consequently, the toner images formed on the surfaces of the photosensitive rolls are electrostatically attracted to the intermediate transfer belt 404 and transferred onto the surface of the intermediate transfer belt 404. In the printer 1, timing for formation of the toner images in the image forming sections 4Y, 4M, 4C, and 4K and timing for voltage application in the primary transfer section 40 are adjusted to the toner images of the colors are superimposed and transferred in the same position on the circulating intermediate transfer belt 404. A stacked toner image obtained by stacking the toner images of the four colors is transferred onto the recording medium by the secondary transfer section 41.

The secondary transfer section 41 includes the secondary transfer roll 411 and the backup roll 403. The backup roll 403 is arranged on the inner circumferential surface side of the intermediate transfer belt 404 and grounded. The secondary transfer roll 411 is arranged to be opposed to the backup roll 403 across the intermediate transfer belt 404. As explained in detail later the secondary transfer roll 411 is held by the opening and closing member 10. When the opening and closing member 10 is opened, the secondary transfer roll 411 separates from the intermediate transfer belt 404 and the backup roll 403. The secondary transfer section 41 is equivalent to an example of a recording device and a transfer recording device in the present invention.

The backup roll 403 is equivalent to an example of a first member in the present invention. The secondary transfer roll 411 is equivalent to an example of a second member in the present invention.

A voltage is applied to the secondary transfer roll 411. An electric field is formed between the secondary transfer roll 411 and the backup roll 403. The stacked toner image transferred on the intermediate transfer belt 404 is secondarily transferred onto the recording medium, which is conveyed along the conveying path L, by this electric field.

In recent years, a floor area occupied by a printer is requested to be reduced. To meet this request, a form like that of the printer 1 according to this exemplary embodiment for lifting a recording medium, which is drawn out in the horizontal direction, along a conveying path extending in the vertical direction, for performing transfer of a toner image, and for fixing of the toner image onto the recording medium halfway in the conveying path is adopted.

In the printer of such a type, it is necessary to turn the recording medium, which is drawn out in the horizontal direction, upward in the vertical direction.

Therefore, the printer 1 includes a turning guide 7 shown at a corner on the lower left of FIG. 2. The turning guide 7 is provided in a place where a conveying direction of the recording medium is changed. The turning guide 7 guides the recording medium along the conveying path L. The turning guide 7 is equivalent to an example of a guide member in the present invention.

The turning guide 7 is a tabular member, a longitudinal direction of which extends in the direction perpendicular to FIG. 2. The turning guide 7 includes, at the lower end, a rotating shaft 70 extending in the direction perpendicular to the paper surface. The turning guide 7 includes convex sections 71 at the upper end. The opening and closing member 10 includes projections 101 in positions where the projections 101 are in contact with the convex sections 71 when the opening and closing member 10 is closed.

The turning guide 7 stands between the opening and closing member 10 and the conveying path L and changes a conveying direction of the recording medium when the opening and closing member 10 is closed. The turning guide 7 falls toward the opening and closing member 10 and exposes the conveying path L as the opening and closing member 10 is opened. As the opening and closing member 10 is closed, the turning guide 7 gradually rises according to the interaction of the projections 101 and the convex sections 71. The movement of the turning guide 7 is associated with the movement of the opening and closing member 10 in this way. This is because the user often opens the opening and closing member 10 for the purpose of removing a recording medium jammed in the conveying path L. In the printer 1, since the secondary transfer roll 411 is held on the opening and closing member 10 side, when the opening and closing member 10 is opened, a gap between the secondary transfer roll 411, which is a part of the conveying path L, and the intermediate transfer belt 404 is widened. This contributes to the removal of the jammed recording medium.

The printer 1 includes an optical sensor 400 and an acting member 8 in order to detect a jam of a recording medium on the inner side of the turning guide 7.

The optical sensor 400 includes a light emitting section and a light receiving section. The optical sensor 400 irradiates light from the light emitting section to the light receiving section. The light receiving section outputs an ON/OFF signal according to whether the light is received. The signal output by the optical sensor 400 is transmitted to the control section 6.

The acting member 8 is a crank-like metal bar, linear sections 81 at both ends of which are present on extended lines thereof. The linear sections 81 at both the ends are supported by a pair of supporting members 800 (see FIG. 3). Therefore, the posture of the acting member 8 changes around the linear sections 81. As explained below, the acting member 8 and the optical sensor 400 cooperate with each other to detect a recording medium. The optical sensor 400 and the acting member 8, as integrated, are equivalent to an example of a first detector in the present invention.

The acting member 8 includes a bent section 82 that connects the linear sections 81 at both the ends. A first projecting section 83 projects from the bent section 82. The first projecting section 83 projects to the conveying path L side piercing through the turning guide 7. The first projecting section 83 is pushed up by the leading end of the recording medium conveyed along the conveying path L. A second projecting section 84 projects from the linear section 81. When the posture of the acting member 8 changes around the linear sections 81 according to the push-up of the first projecting section 83 by the recording medium, the second projecting section 84 exits from between the light emitting section and the light receiving section of the optical sensor 400. Consequently, the light receiving section receives light. As a result, the recording medium is detected. Thereafter, when the recording medium finishes passing through the optical sensor 400, the pushed-up first projecting section 83 falls and the second projecting section 84 enters between the light emitting section and the light receiving section of the optical sensor 400. Consequently, the light receiving section cannot receive light. The control section 6 grasps the length of the recording medium being conveyed on the conveying path L and the conveying speed of the recording medium. The control section 6 calculates time (a predicted time) from the time when the first projecting section 83 is pushed up (the ON signal) until the first projecting section 83 is considered to fall (the OFF signal). The control section 6 measures, on the basis of the signal from the optical sensor 400, time (an actual time) from the time when the recording medium actually starts to pass the inner side of the turning guide 7 until the recording medium finishes passing through the turning guide 7, i.e., time from the time when the first projecting section 83 is actually pushed up until the first projecting section 83 falls. Consequently, at a point when the actual time is longer than the predicted time by time exceeding a tolerance time set in advance, the control section 6 recognizes that a jam of the recording medium occurs on the inner side of the turning guide 7.

Figure 3:
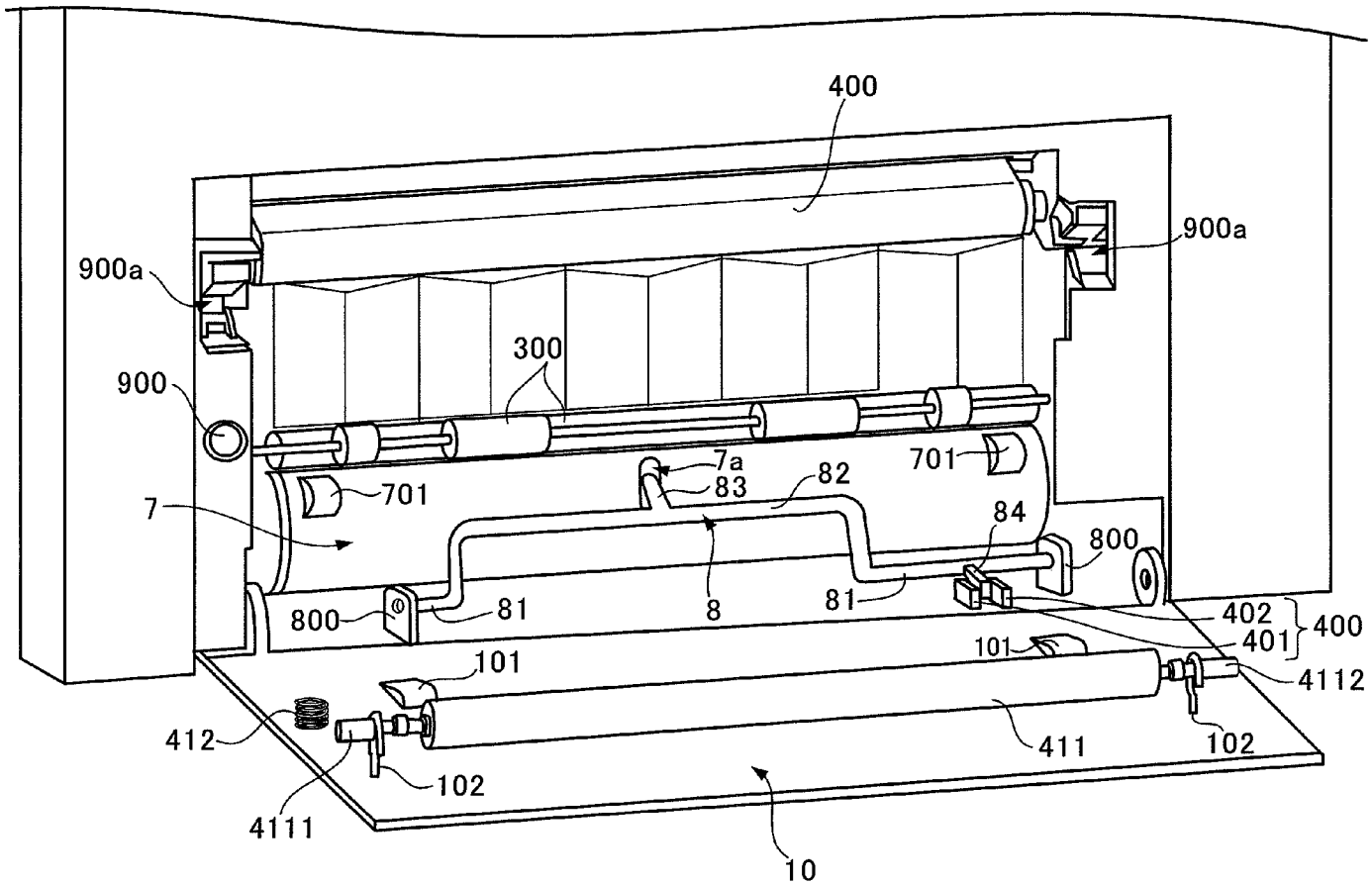
FIG. 3 is a diagram showing a part of the conveying path of the printer.

FIG. 3 is a diagram showing a part of the conveying path of the printer.

Figure 4:
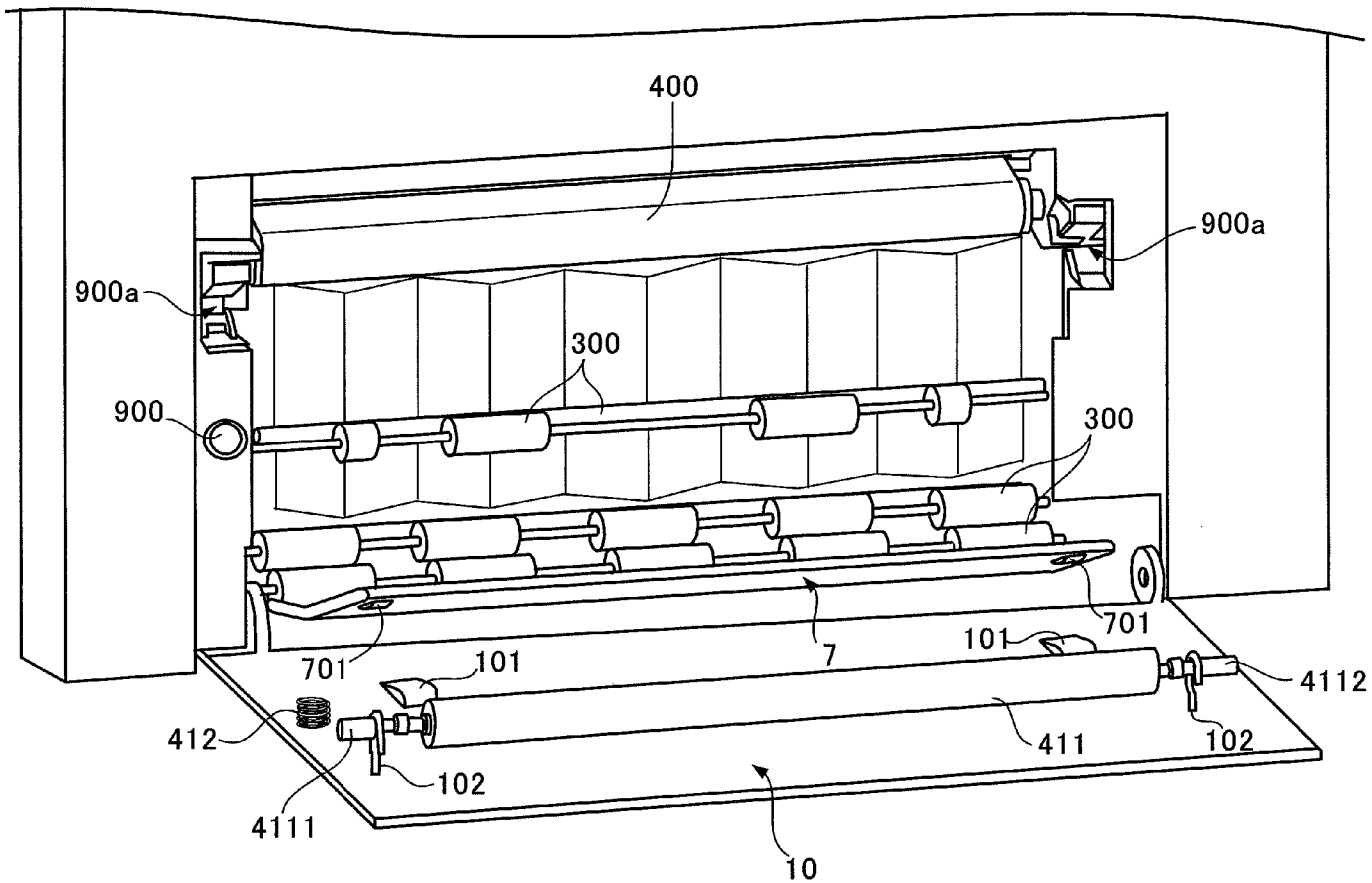
FIG. 4 is a diagram showing in detail a part of the conveying path of the printer.

In FIG. 3, a state in which a part of the conveying path of the printer 1 is exposed by the opening of the opening and closing member 10 is shown. In FIG. 3, for convenience of explanation, the turning guide 7 that should originally fall to the opening and closing member 10 side according to the opening of the opening and closing member 10 as shown in FIG. 4 is shown in a standing state. In FIG. 3, the conveying roll pairs 300 and the intermediate transfer belt 404 provided along the conveying path are shown.

On the inner side of the opening and closing member 10, insulative holding members 102 that respectively hold a conductive bearing 4111, which supports one end of the secondary transfer roll 411, and an insulative bearing 4112, which supports the other end, are attached. On the printer main body side, cutouts 900*a* that receive both end portions of the secondary transfer roll 411 are provided.

A power feeding spring 412 that applies a voltage to the secondary transfer roll 411 held by the insulative holding, members 102 is attached to the opening and closing member 10. A supply path for the voltage is explained later. On the printer main body side, an electric contact 900 is provided in a position corresponding to the power feeding spring 412 attached to the opening and closing member 10. The secondary transfer roll 411 receives voltage application from the printer main body side through the power feeding spring 412 that comes into contact with the electric contact 900 on the printer main body side according to the closing of the opening and closing member 10. The power feeding spring 412 is equivalent to an example of a breaker in the present invention.

As explained above, the acting member 8 is the metal bar bent in a crank shape. The bent section 82 that connects the linear sections 81 at both the ends has a shape once extending in a perpendicular direction with respect to one linear section 81, then bent and extending in parallel to the linear sections 81, and bent again toward the other linear section 81.

The acting member 8 includes the first projecting section 83 projecting from the center of the bent section 82 and the second projecting section 84 projecting from the linear section 81.

The optical sensor 400 includes a light emitting section 401 and a light receiving section 402. The second projecting section 84 enters between the light emitting section 401 and the light receiving section 402 and exits from between the light emitting section 401 and the light receiving section 402.

The turning guide 7 includes convex sections 701 that come into contact with projections 101 provided in the opening and closing member 10. The turning guide 7 includes, in the center, a through hole 7*a* through which the first projecting section 83 pierces.

FIG. 4 is a diagram showing in detail a part of the conveying path of the printer.

In FIG. 4, a state in which the turning guide 7 falls to the opening and closing member 10 side according to the opening of the opening and closing member 10 is shown.

When the turning guide 7 falls to the opening and closing member 10 side in this way, the conveying roll pairs 300 arranged near the media cassette behind the turning guide 7 are exposed. Therefore, it is easy to eliminate a jam of a recording medium.

In a general printer, opening of an opening and closing member is surely detected by an expensive component such as an interlock switch.

However, in addition to a reduction in a floor area, there is a market need for an inexpensive printer. To meet the need, it is necessary to adopt a simple configuration not including expensive components.

Therefore, in the printer 1, according to contrivance explained below, an expensive component exclusive for detecting the opening and closing of the opening and closing member 10 is disused.

Figure 5:
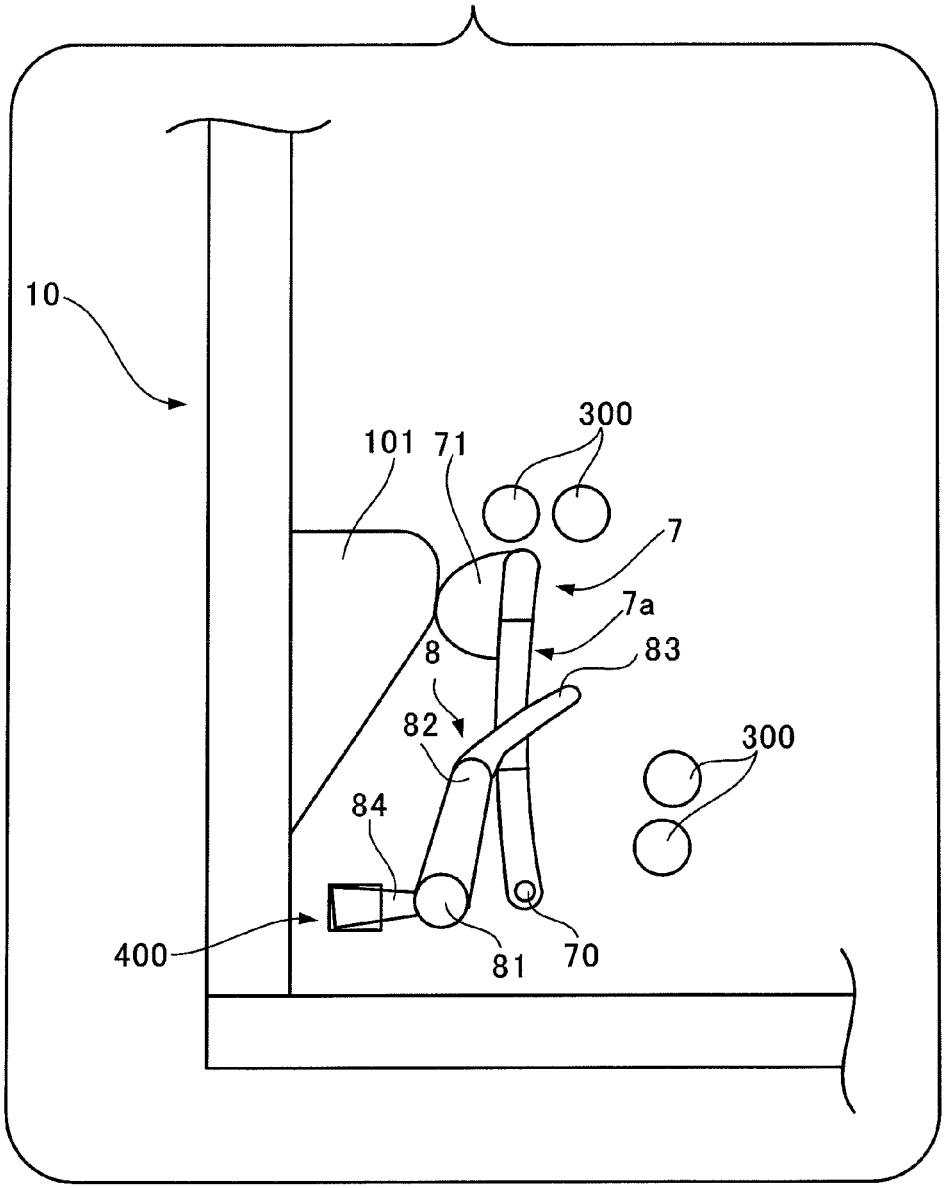
FIG. 5 is an enlarged view of a part of the perspective view shown in FIG. 2.

FIG. 5 is an enlarged view of a part of the perspective view shown in FIG. 2.

In FIG. 5, a perspective enlarged view from a side around the turning guide 7 is shown. A state before a recording medium reaches the turning guide 7 is shown.

Before the recording medium reaches the turning guide 7, the first projecting section 83 of the acting member 8 falls to near an edge on the lower side of the through hole 7*a* of the turning guide 7. The second projecting section 84 is within a detection range of the optical sensor 400.

Figure 6:
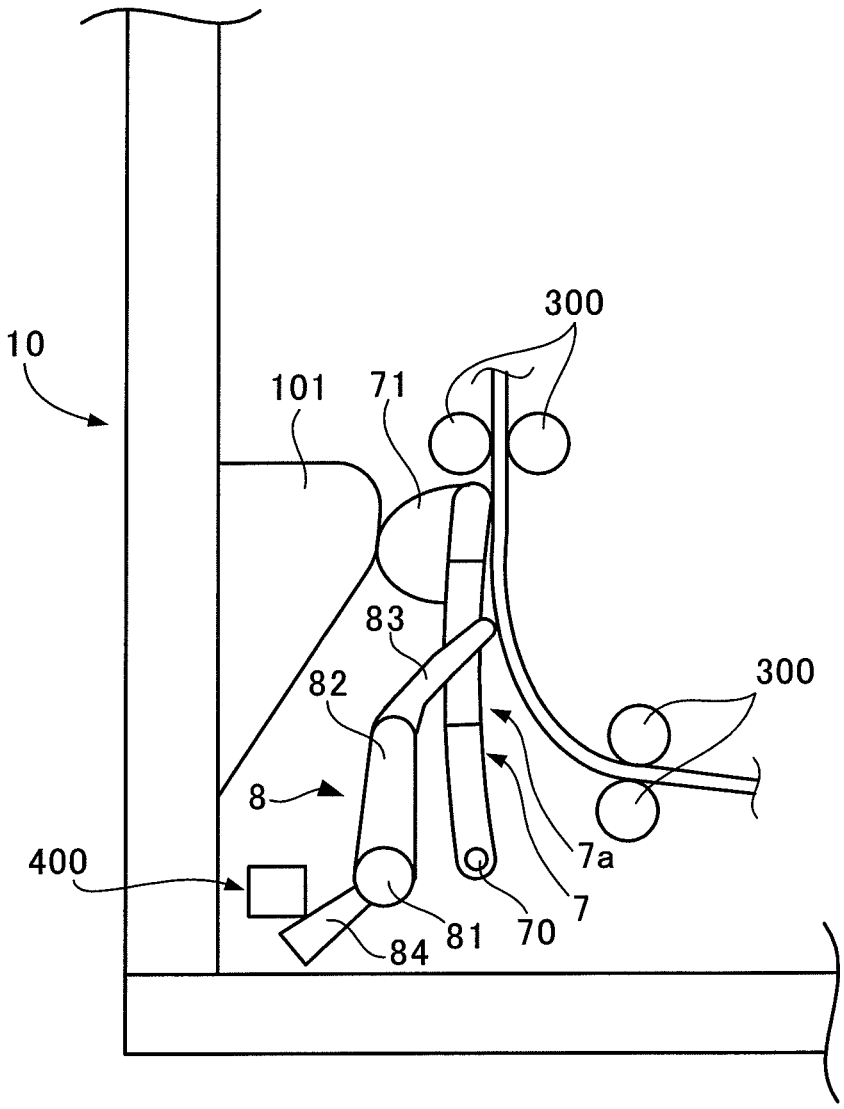
FIG. 6 is a diagram showing a state after the recording medium reaches the turning guide.

FIG. 6 is a diagram showing a state after the recording medium reaches the turning guide 7.

The first projecting section 83 of the acting member 8 is pushed up by the recording medium, which reaches the turning guide 7, and rises to near the center of the through hole 7*a* of the turning guide 7. The second projecting section 84 is out of the detection range of the optical sensor 400. The control section 6 performs the measurement of the actual time as explained above. At a point when the actual time is longer than the predicted time by time exceeding the tolerance time set in advance, the control section 6 recognizes that a jam of the recording medium occurs on the inner side of the turning guide 7.

Figure 7:
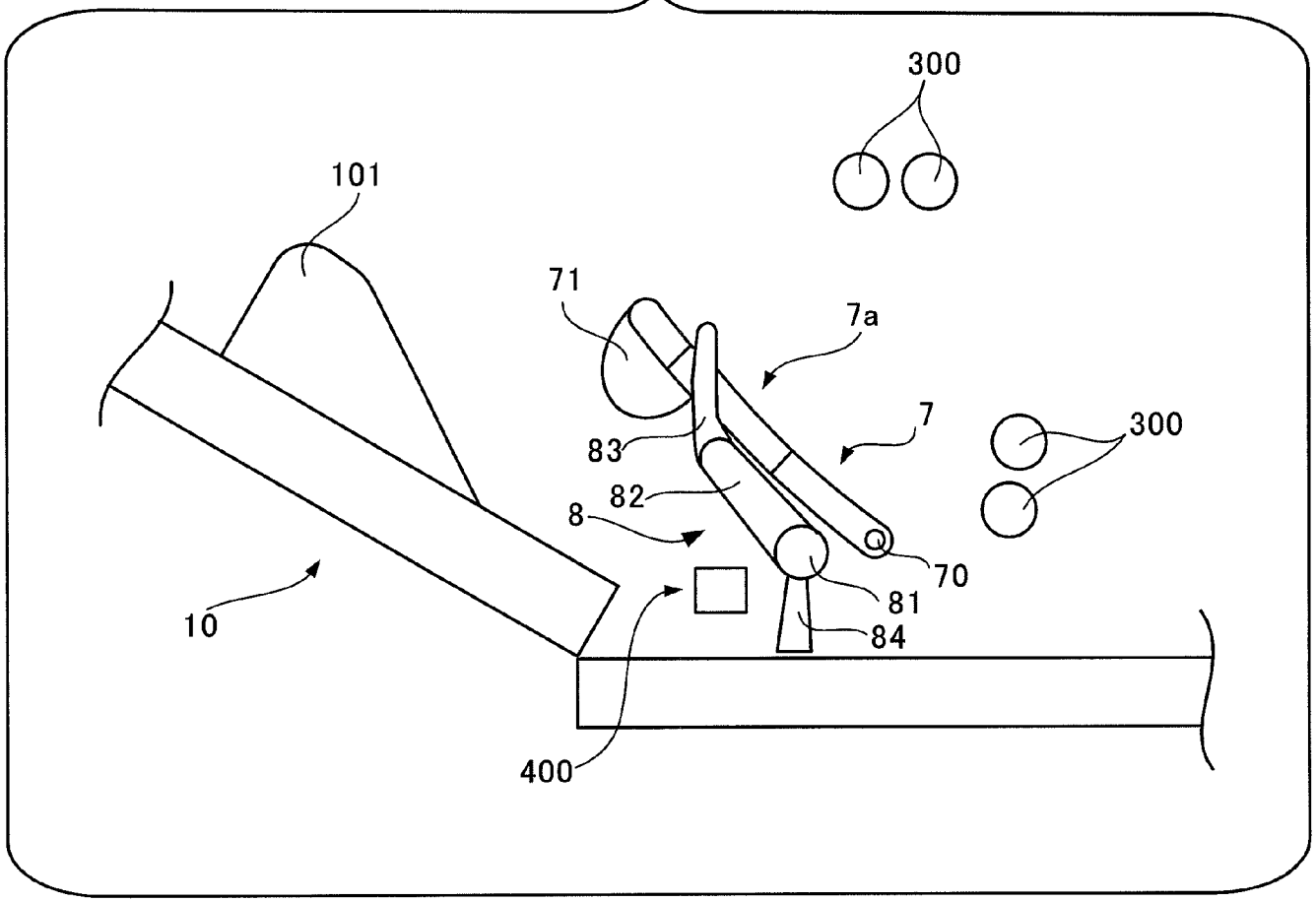
FIG. 7 is a diagram showing a state in which the turning guide falls to the opening and closing member side.

FIG. 7 is a diagram showing a state in which the turning guide falls to the opening and closing member side.

In FIG. 7, a state in which the turning guide 7 falls in the direction of the opening and closing member 10 according to the opening of the opening and closing member 10 is shown.

When the turning guide 7 falls in the direction of the opening and closing member 10, the first projecting section 83 of the acting member 8 rotates largely around the linear sections 81 and moves away from the conveying path L to near an edge on the upper side of the through hole 7*a* of the turning guide 7. In other words, the structure of the first detector including the acting member 8 and the optical sensor 400 changes. As a result, the second projecting section 84 deviates from the detection range of the optical sensor 400. Therefore, the ON signal, which is the same as the ON signal output when the recording medium passes the inner side of the turning guide 7, is output from the optical sensor 400.

The projections 101 separate from the convex sections 71 according to the opening of the opening and closing member 10, the turning guide 7 falls down because the support by the projections 101 is removed, and the acting member 8 is moved because the turning guide 7 falls down. A series of mechanisms for the movement is equivalent to an example of an interlocking mechanism in the present invention.

The control section 6 cannot distinguish whether the actual time is longer than the predicted time by time exceeding the tolerance time set in advance because the opening and closing member 10 is opened or because a jam of the recording medium occurs on the inner side of the turning guide 7.

In this way, in the printer 1, it cannot be distinguished which of a jam of the recording medium and the opening of the opening and closing member 10 occurs. However, if the opening and closing member 10 is opened, the opening is detected.

Therefore, in the printer 1, at a point when the actual time is longer than the predicted time by time exceeding the tolerance time set in advance, a message "Please open the opening and closing member and check whether a recording member jams. Please firmly close the opening and closing member" is displayed on the operation/display panel 200. While the display is maintained, voltage application to the operating sections is stopped. In this way, the message for causing the user to check both a jam of the recording medium and the opening of the opening and closing member 10 is displayed. Therefore, the user needs to check both a jam of the recording medium and the opening of the opening and closing member 10. However, since the check of a jam of the recording medium always involves the opening and closing of the opening and closing member 10, it is unlikely that a large burden is given to the user.

In the printer 1, the power feeding spring 412 (see FIG. 3) separates from the electric contact 900 on the printer main body side. Consequently, voltage application to the secondary transfer roll 411 held by the opening and closing member 10 is stopped.

Figure 8:
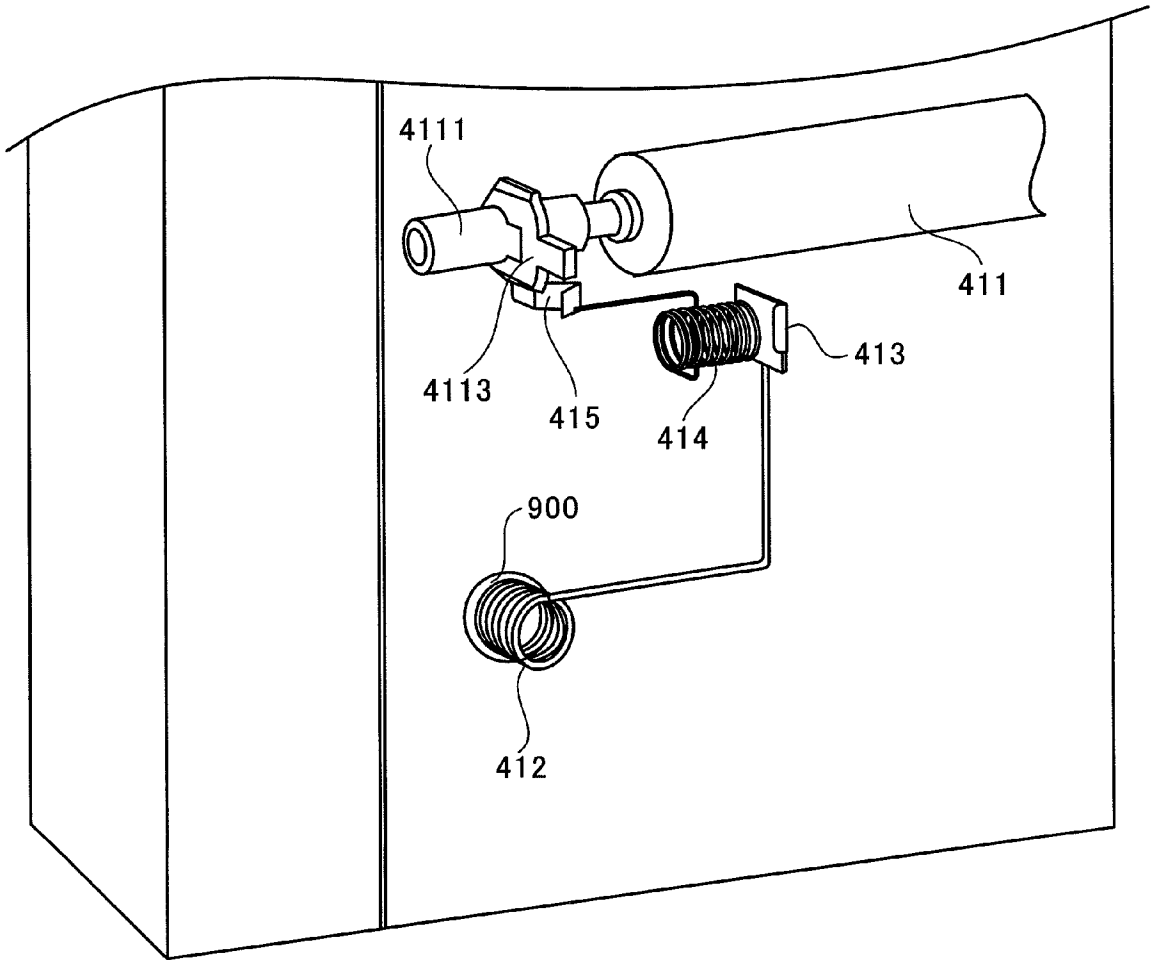
FIG. 8 is a diagram showing a voltage application circuit for applying a voltage to the secondary transfer roll.

FIG. 8 is a diagram showing a voltage application circuit for applying a voltage to the secondary transfer roll.

Members excluding the electric contact 900 among members shown in FIG. 8 are disposed on the opening and closing member 10 side.

The power feeding spring 412 in contact with the electric contact 900 is connected to a swinging spring 414 via a pedestal plate 413, which is a part of the voltage application circuit.

The swinging spring 414 is connected to a contact pedestal 4113, which is fixed to the conductive bearing 4111, via a contact 415. The swinging spring 414 presses the contact 415 against the pedestal plate 413 and surely maintains conduction while extending and contracting according to swing in an axis direction of the secondary transfer roll 411.

When the opening and closing member 10 is opened and the electric contact 900 and the power feeding spring 412 in contact with each other separate, voltage application to the secondary transfer roll 411 by the voltage application circuit is stopped. This prevents a situation in which, when the user opens the opening and closing member 10, the user touches, by mistake, the secondary transfer roll 411 to which a voltage is applied.

In the printer 1, while the message based on the signal from the optical sensor 400 is displayed, the voltage application to the operating sections is stopped. Thereafter, because the signal from the optical sensor 400 is the OFF signal indicating normality rather than the ON signal indicating a jam of the recording medium or the opening of the opening and closing member, the control section 6 confirms that a jam of the recording medium is removed and the opening and closing member 10 is closed by the user. Consequently, in the printer 1, the supply of electric power to the operating sections is resumed.

A second exemplary embodiment common to the conveying apparatus of the present invention and the image forming apparatus of the present invention is explained below.

The second exemplary embodiment and the first exemplary embodiment are different in a method of detecting a jam of a recording medium on the inner side of a turning guide. The second exemplary embodiment is different from the first exemplary embodiment in that the surface potential of the intermediate transfer belt 404 is measured in a position close to the secondary transfer roll 411.

Figure 9:
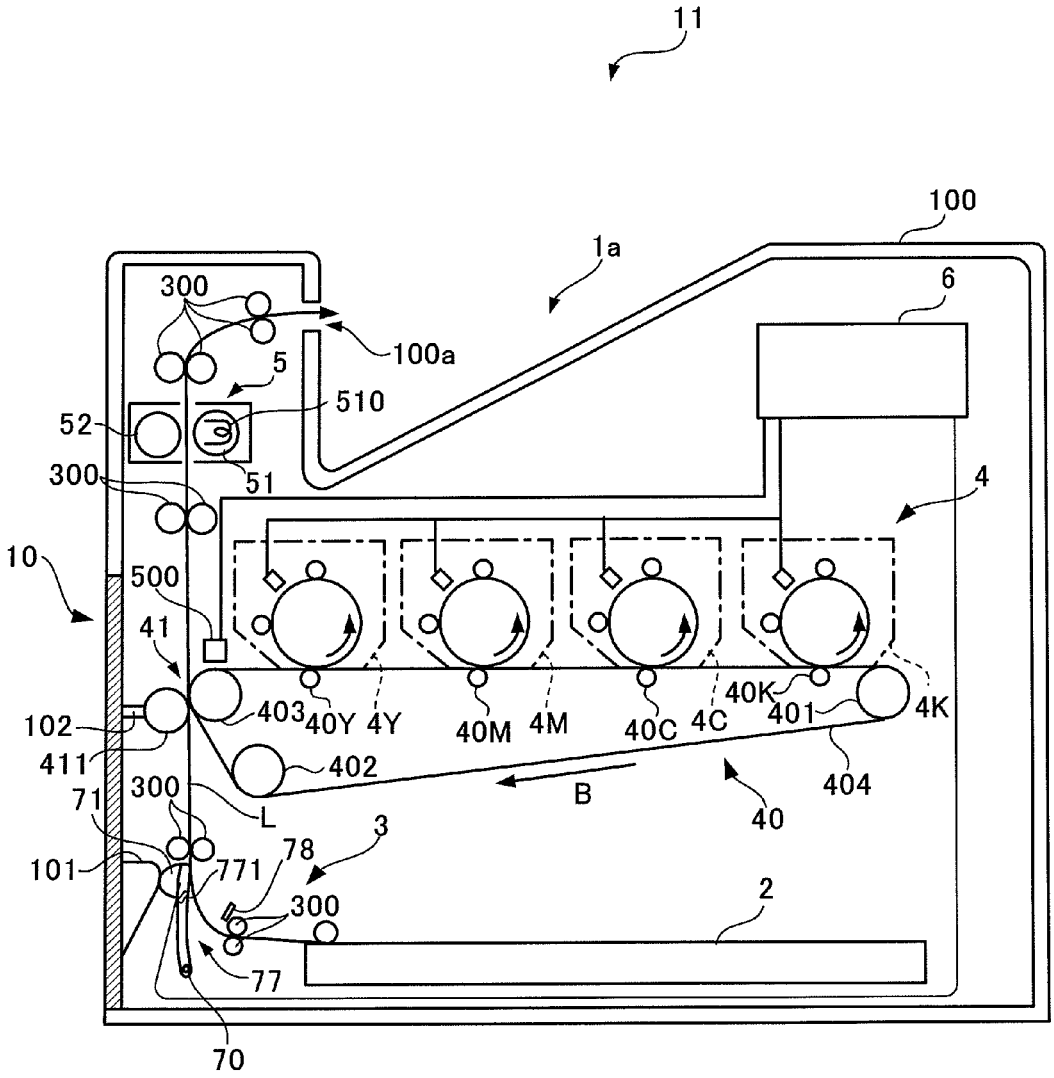
FIG. 9 is a perspective view of a printer according to the second exemplary embodiment viewed from a side.

FIG. 9 is a perspective view of a printer according to the second exemplary embodiment viewed from a side. In FIG. 9, members of types that are the same as the members shown in FIG. 2 are denoted by reference numerals and signs that are the same as those shown in FIG. 2.

In a printer 11 according to the second exemplary embodiment, an optical sensor 771 is attached to a turning guide 77. The printer 11 includes a reflection plate 78 in a section opposed to the turning guide 77 in a standing state across the conveying path L. In the printer 11, a potential measuring device 500 measures the surface potential of the intermediate transfer belt 404. The potential measuring device 500 is an inexpensive component compared with an interlock switch. The optical sensor 771 and the reflection plate 78 detect a recording medium in cooperation with each other as explained below. The optical sensor 771 and the reflection plate 78, as integrated, are equivalent to an example of the first detector in the present invention.

Figure 10:
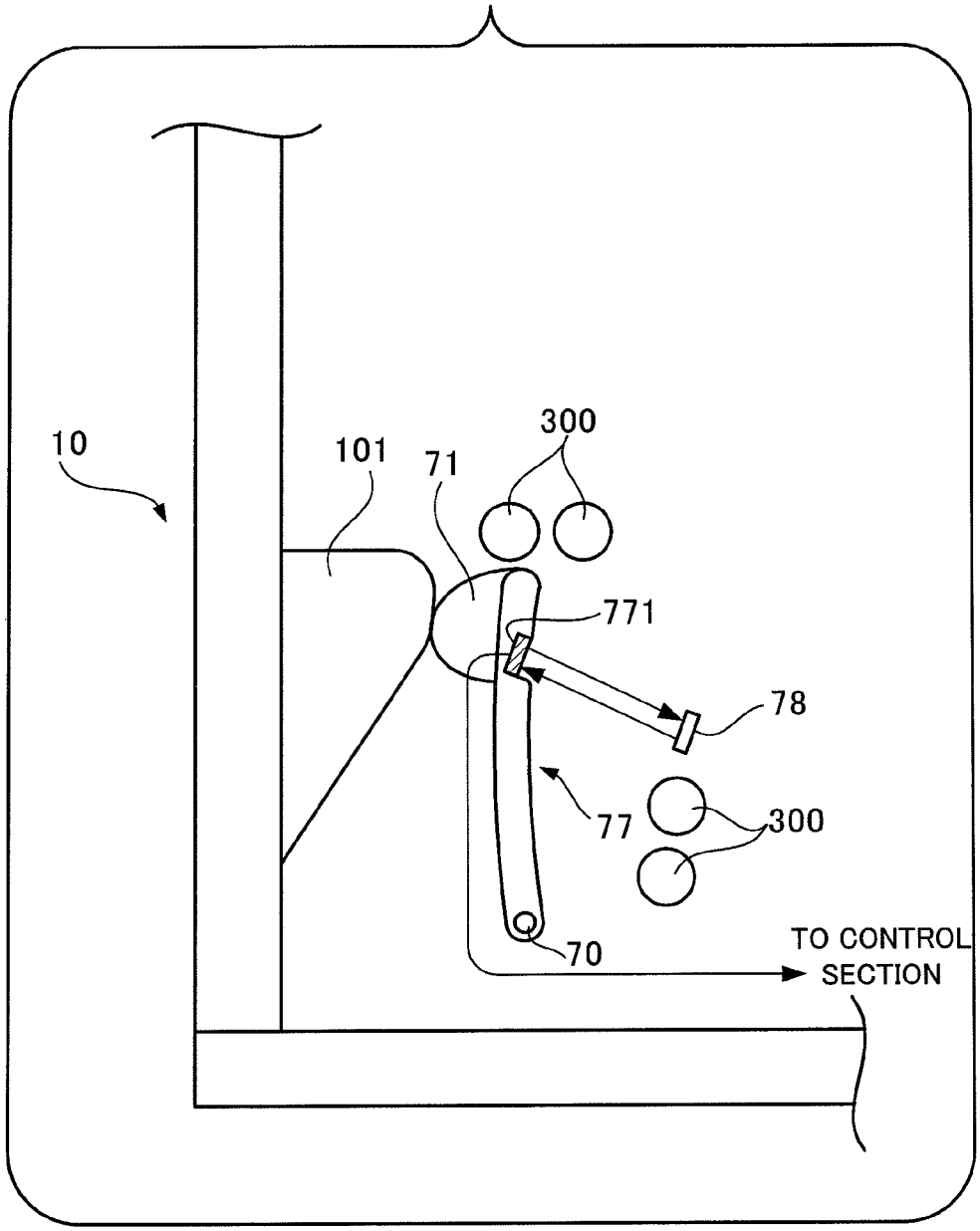
FIG. 10 is an enlarged view of a part of the perspective view shown in FIG. 9.

FIG. 10 is an enlarged view of a part of the perspective view shown in FIG. 9.

In FIG. 10, a neighborhood of the turning guide 77 is shown. A state before a recording medium reaches the turning guide 77 is shown.

The optical sensor 771 attached to the turning guide 77 receives light emitted from the optical sensor 771 and reflected by the reflection plate 78 before the recording medium reaches the turning guide 77. This light reception is realized because of specific arrangement in which the optical sensor 771 and the reflection plate 78 are opposed to each other. The optical sensor 771 transmits a signal indicating that the light is received to the control section 6.

Figure 11:
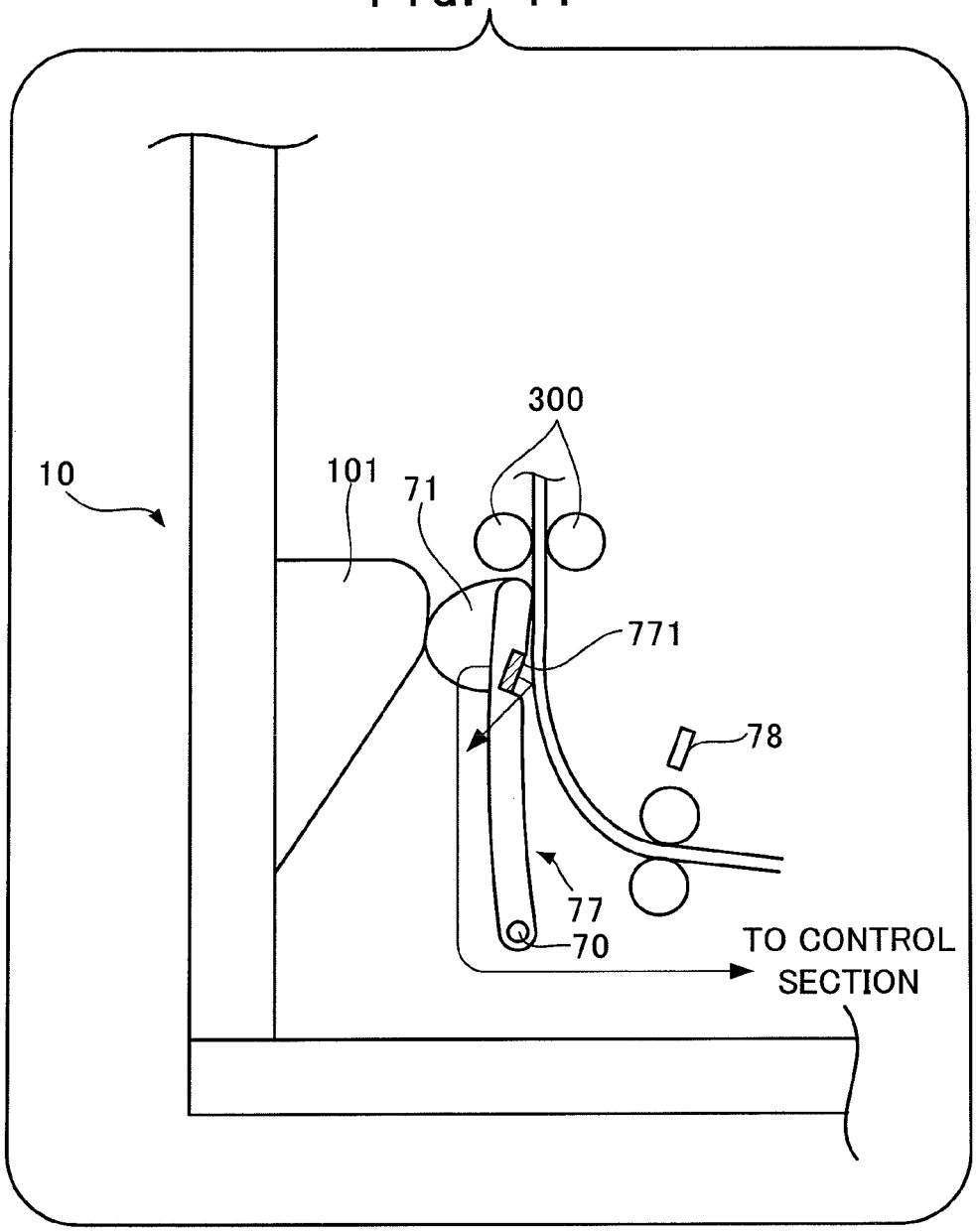
FIG. 11 is a diagram showing a state after the recording medium reaches the turning guide.

FIG. 11 is a diagram showing a state after the recording medium reaches the turning guide.

When the recording medium reaches the turning guide 77, since the recording medium enters between the optical sensor 771 and the reflection plate 78, light emitted from the optical sensor 771 is blocked by the recording medium. Therefore, the optical sensor 771 transmits an OFF signal indicating that the light is not received to the control section 6.

The control section 6 measures an elapsed time after reception of the OFF signal and, at a point when the measured time (an actual time) is longer than a predicted time by time exceeding a tolerance time set in advance, recognizes that a jam of the recording medium occurs on the inner side of the turning guide 77.

Figure 12:
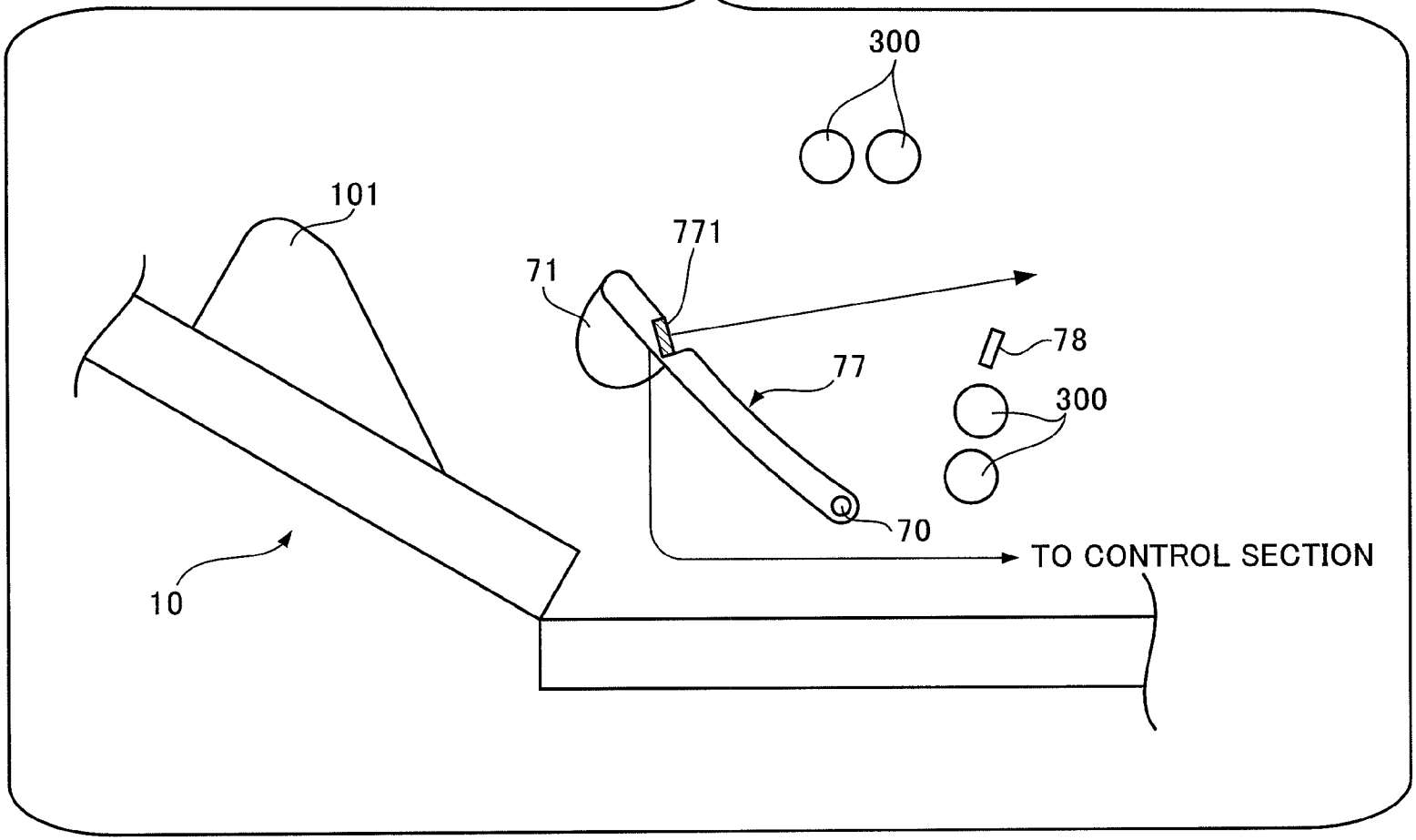
FIG. 12 is a diagram showing a state in which the turning guide falls to the opening and closing member side.

FIG. 12 is a diagram showing a state in which the turning guide falls to the opening and closing member side.

In FIG. 12, a state in which the turning guide 77 falls in the direction of the opening and closing member 10 according to the opening of the opening and closing member 10 is shown.

When the turning guide 77 falls in the direction of the opening and closing member 10 according to the opening of the opening and closing member 10, the optical sensor 771 attached to the turning guide 77 deviates from the position opposed to the reflection plate 78 and is arranged differently from the specific arrangement. In other words, the structure of the first detector including the optical sensor 771 and the reflection plate 78 changes. As a result, the optical sensor 771 does not receive the reflected light and transmits an OFF signal to the control section 6. The projections 101 separate from the convex sections 71 according to the opening of the opening and closing member 10, the turning guide 7 falls down because the support by the projections 101 is removed, and the optical sensor 771 is moved because the turning guide 7 falls down. A series of mechanisms for the movement is equivalent to an example of the interlocking mechanism in the present invention.

The control section 6 does not distinguish this OFF signal from the OFF signal transmitted when the recording medium reaches the turning guide 77.

Therefore, at a point when the actual time is longer than the predicted time by time exceeding the tolerance time set in advance, the control section 6 recognizes that a jam of the recording medium or the opening of the opening and closing member 10 occurs.

In the printer 11, a potential measuring device 500 (see FIG. 9) for measuring the surface potential of the intermediate transfer belt 404 is provided in a position close to the secondary transfer roll 411. A signal indicating the potential measured by the potential measuring device 500 is transmitted to the control section 6. In the secondary transfer section 41, as explained above, an electric field is formed between the secondary transfer roll 411 to which a voltage is applied and the grounded backup roll 403 and a stacked toner image is transferred onto the recording medium. The control section 6 monitors, using the potential measuring device 500, the surface potential of a region of the intermediate transfer belt 404 immediately after finishing facing the secondary transfer roll 411 to which the voltage is applied. Consequently, the control section 6 grasps a change in an electrostatic state between the secondary transfer roll 411 and the intermediate transfer belt 404. The potential measuring device 500 is equivalent to an example of a second detector in the present invention.

The electrostatic state between the secondary transfer roll 411 and the intermediate transfer belt 404 changes because of various factors. In the printer 11, if a large change exceeding a change that could occur during a normal image forming operation occurs in the potential measured by the potential measuring device 500, the control section 6 immediately stops the voltage application to the secondary transfer roll 411. If the opening and closing member 10 is opened even a little, a distance between the secondary transfer roll 411 and the intermediate transfer belt 404 increases and the electrostatic state between the secondary transfer roll 411 and the intermediate transfer belt 404 substantially changes. As a result, in the printer 11, when the opening and closing member 10 is opened, the voltage application to the secondary transfer roll 411 is stopped. Since the voltage application is stopped in this way, a situation in which, when a user opens the opening and closing member 10, the user touches the secondary transfer roll 411 to which a voltage is applied is prevented and safety is secured. In the printer 11, if the opening and closing member 10 is opened even a little, the potential measuring device 500 detects a change in an electrostatic state. Therefore, the change is quickly detected without waiting for a point when the actual time is longer than the predicted time by time exceeding the tolerance time.

Lastly, a third exemplary embodiment common to the conveying apparatus of the present invention and the image forming apparatus of the present invention is explained.

The third exemplary embodiment and the first exemplary embodiment are different in a method of detecting a jam of a recording medium on the inner side of a turning guide. The third exemplary embodiment is different from the first exemplary embodiment in that the secondary transfer roll 411 is housed in a printer main body rather than the opening and closing member 10. The third exemplary embodiment is also different from the first exemplary embodiment in that voltage application to the secondary transfer roll 411 is performed by an electric circuit connected by inserting a conductive member on the opening and closing member side into a gap on the main body side and, when the opening and closing member 10 is opened, the conductive member slips off the gap, the electric circuit is interrupted, and the voltage application to the secondary transfer roll 411 is cut. These differences are explained below. The conductive member is equivalent to an example of a breaker in the present invention.

Figure 13:
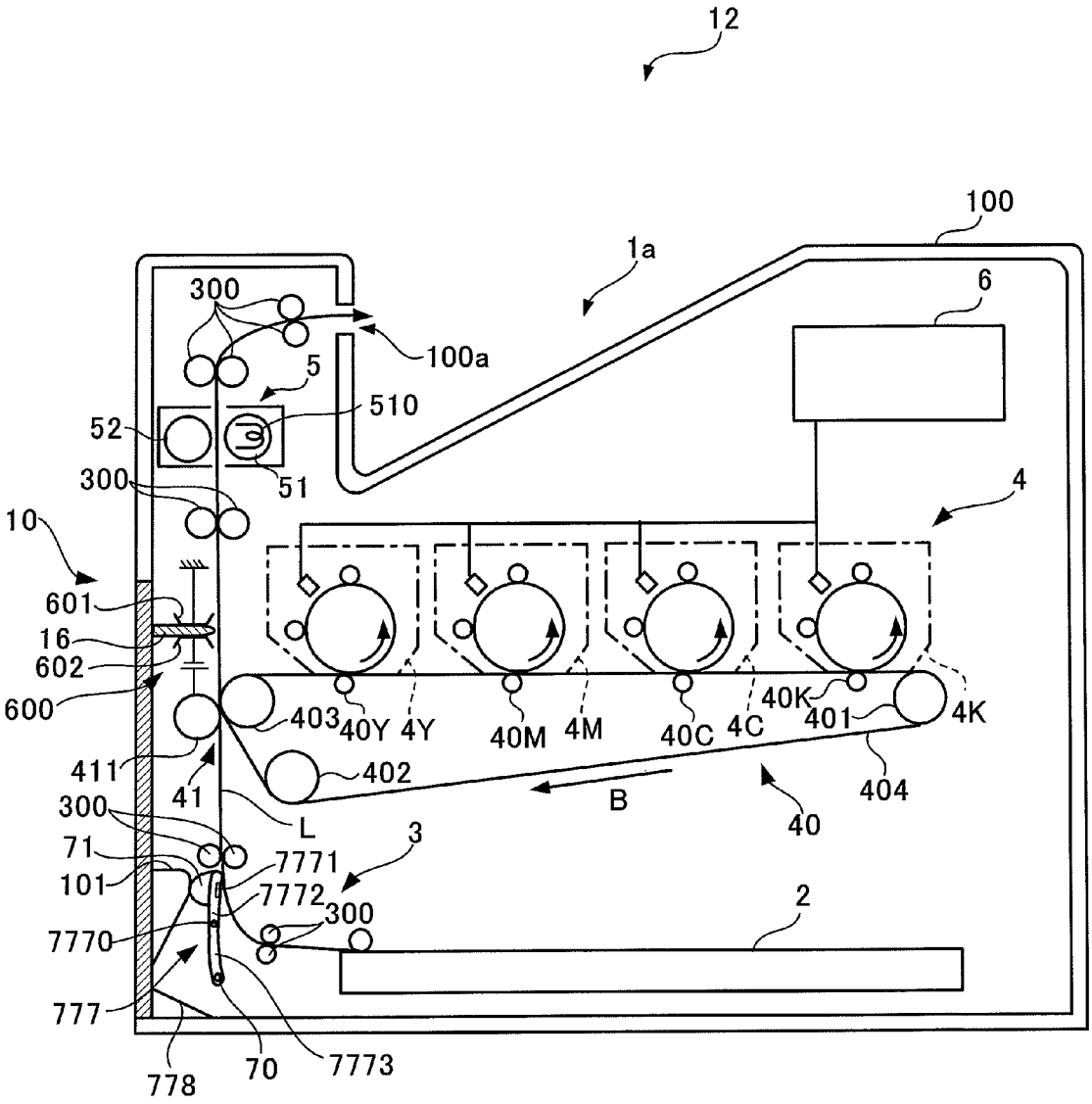
FIG. 13 is a perspective view from a side of a printer according to the third exemplary embodiment.

FIG. 13 is a perspective view from a side of a printer according to the third exemplary embodiment. In FIG. 13, members of types that are the same as the members shown in FIG. 2 are denoted by reference numerals and signs that are the same as those shown in FIG. 2.

In a printer 12 according to the third exemplary embodiment, an optical sensor 7771 is attached to a turning guide 777. An upper part 7772 and a lower part 7773 of the turning guide 777 are coupled to a coupling shaft 7770 extending in a direction perpendicular to FIG. 13. The optical sensor 7771 is a sensor that receives, when an object covers the right front of the optical sensor 7771, reflected light from the object and outputs an ON signal. In the third exemplary embodiment, as explained later, the optical sensor 7771 alone detects a recording medium. The optical sensor 7771 is equivalent to the first detector in the present invention.

The printer 12 includes an electric circuit 600 that performs voltage application to the secondary transfer roll 411. Since a conductive member 16 on the opening and closing member side is inserted into a gap between contacts 601 and 602 on the main body side, a voltage is applied to the secondary transfer roll 411. On the other hand, when the opening and closing member 10 is opened and the conductive member 16 slips off the gap between the contacts 601 and 602, the electric circuit is interrupted and the voltage supply to the secondary transfer roll 411 is cut.

Figure 14:
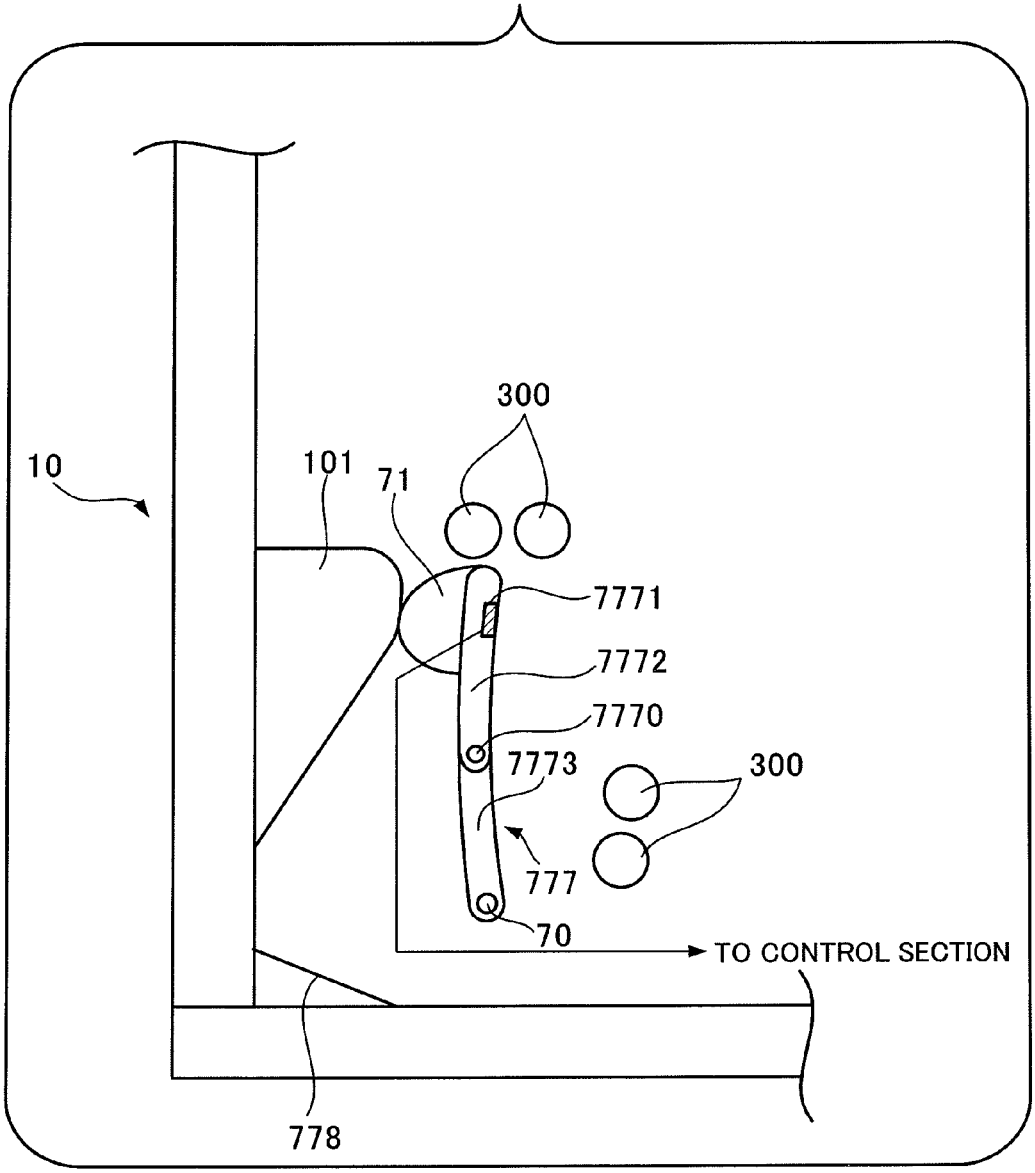
FIG. 14 is an enlarged view of a part of the perspective view shown in FIG. 13.

FIG. 14 is an enlarged view of a part of the perspective view shown in FIG. 13.

In FIG. 14, a neighborhood of the turning guide 777 are shown. A state before a recording medium reaches the turning guide 777 is shown.

Before the recording medium reaches the turning guide 777, the optical sensor 7771 attached to the turning guide 777 does not receive reflected light and transmits an OFF signal to the control section 6.

Figure 15:
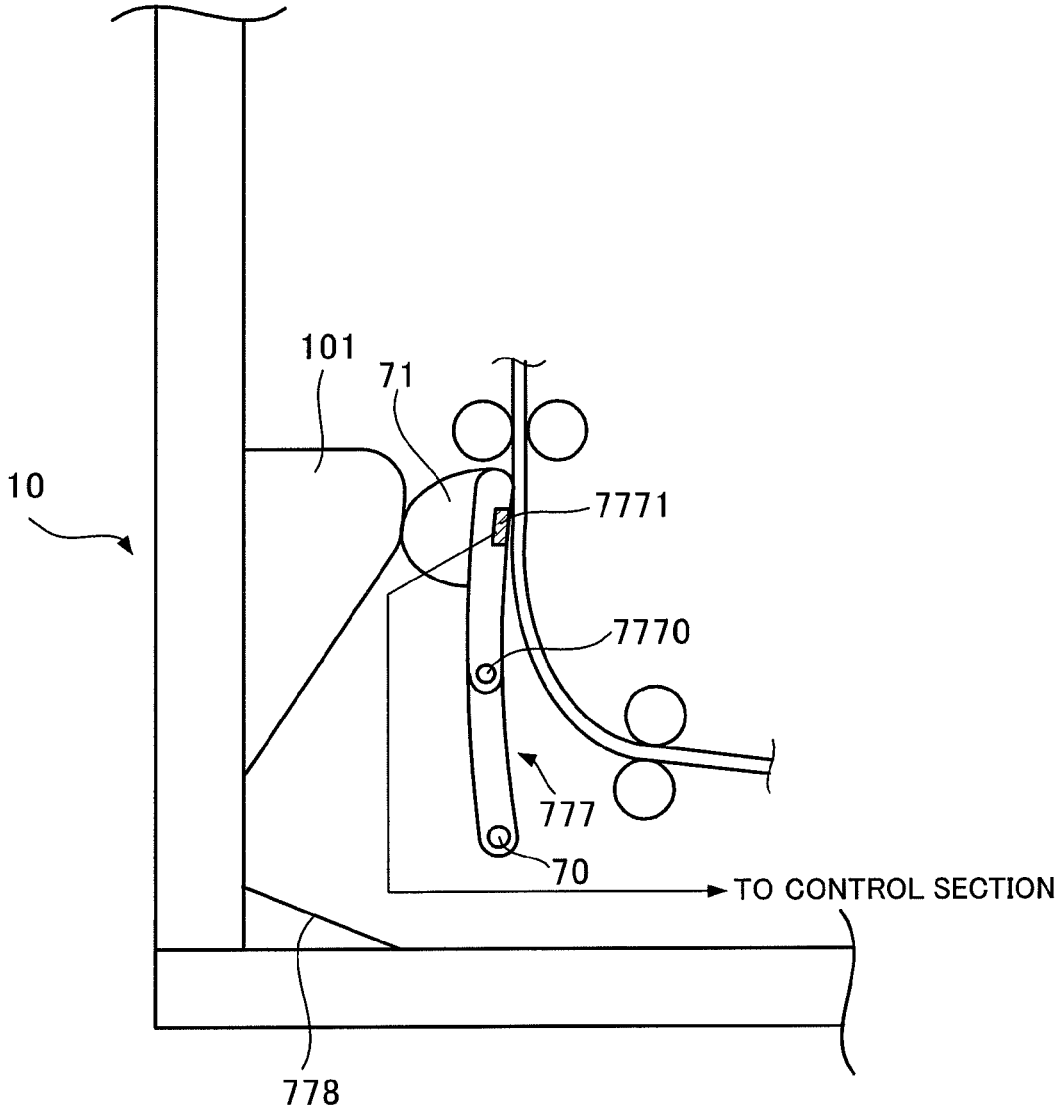
FIG. 15 is a diagram showing a state after the recording medium reaches the turning guide.

FIG. 15 is a diagram showing a state after the recording medium reaches the turning guide.

When the recording medium reaches the turning guide 777, the optical sensor 7771 attached to the turning guide 777 receives reflected light reflected by the recording medium and transmits an ON signal to the control section 6.

The control section 6 measures an elapsed time from the start of reception of the ON signal indicating the reception of the reflected light from the optical sensor 7771 and, at a point when the measured time (an actual time) is longer than a predicted time by time exceeding a tolerance time set in advance, recognizes that a jam of the recording medium occurs on the inner side of the turning guide 777.

Figure 16:
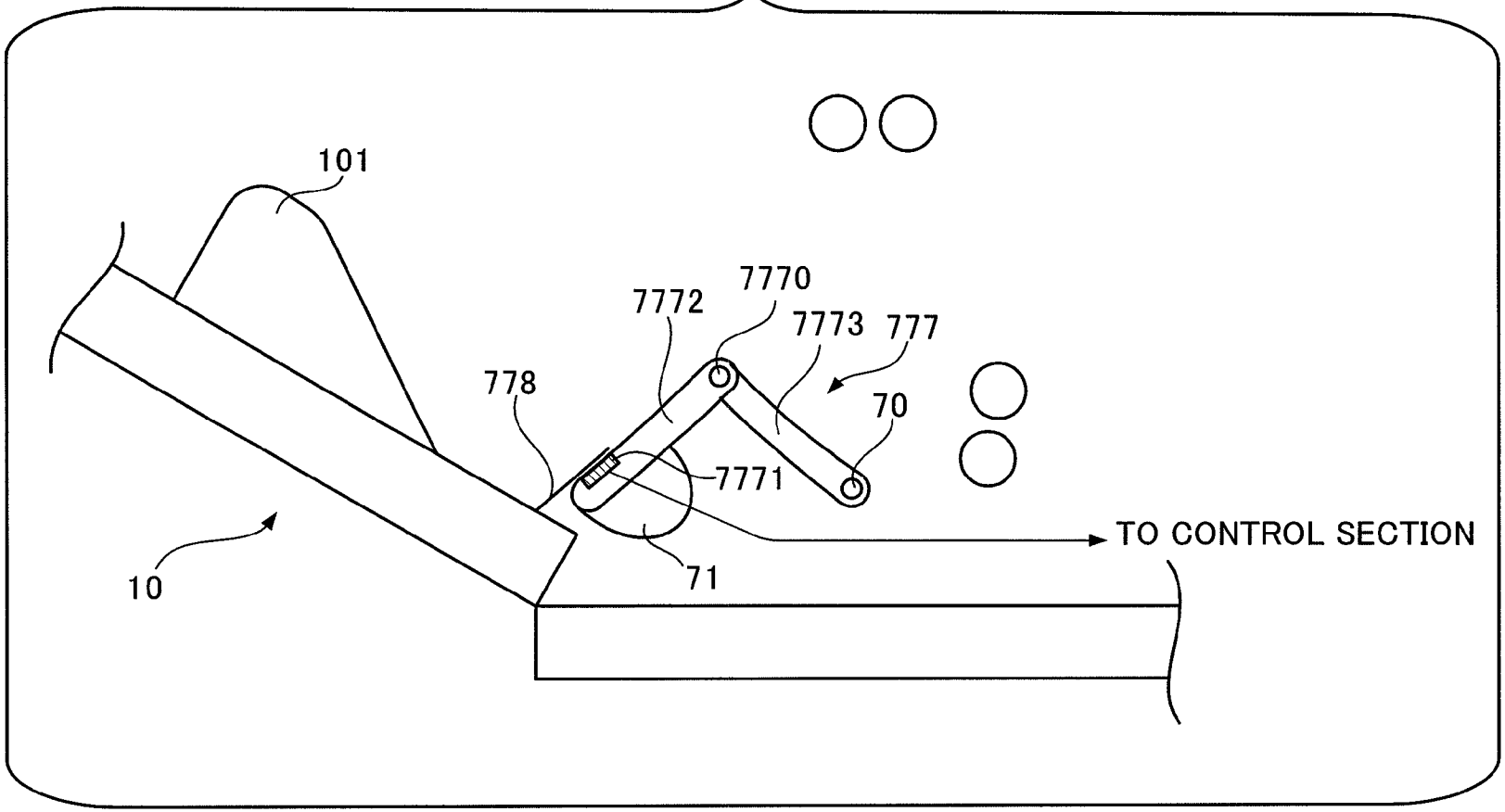
FIG. 16 is a diagram showing a state in which the turning guide falls to the opening and closing member side.

FIG. 16 is a diagram showing a state in which the turning guide falls to the opening and closing member side.

In FIG. 16, a state in which the turning guide 777 falls in the direction of the opening and closing member 10 according to the opening of the opening and closing member 10 is shown.

As explained above, the turning guide 777 includes, in the center, the coupling shaft 7770 extending in the direction perpendicular to FIG. 13. Although not shown in FIG. 16, the turning guide 777 includes a spring member that applies, to the upper part 7772, urging force for quickly rotating the upper part 7772 counterclockwise. Therefore, when the projections 101 of the opening and closing member 10 separate from the convex sections 71 of the turning guide 777, after the upper part 7772 quickly rotates counterclockwise, the turning guide 777 falls in the direction of the opening and closing member 10.

When the turning guide 777 falls in the direction of the opening and closing member 10 according to the opening of the opening and closing member 10, the optical sensor 7771 attached to the turning guide 777 is opposed to a film sheet 778 attached to a lower part of the already-fallen opening and closing member 10. In other words, the position of the first detector, which functions alone, of the optical sensor 7771 changes. As a result, the optical sensor 7771 receives reflected light reflected by the film sheet 778 and transmits an ON signal to the control section 6. The projections 101 separate from the convex sections 71 according to the opening of the opening and closing member 10, the turning guide 777 falls down because the support by the projections 101 is removed, and the optical sensor 7771 is moved because the turning guide 777 falls down. A series of mechanisms for the movement is equivalent to an example of the interlocking mechanism in the present invention.

The control section 6 does not distinguish this ON signal from the ON signal transmitted when the recording medium reaches the turning guide 777.

Therefore, at a point when the actual time is longer than the predicted time by time exceeding the tolerance time set in advance, the control section 6 recognizes that a jam of the recording medium or the opening of the opening and closing member 10 occurs.

In the printer 12, when the opening and closing member 10 is started to be closed by a user, the upper part 7772 of the turning guide 777 is pushed up by a pushing-up mechanism (not shown), which moves in association with the opening and closing member 10, and rotates clockwise. Thereafter, the turning guide 777 rises according to the interaction of the projections 101 and the convex sections 71.

In the printer 11, when the opening and closing member 10 is opened and the conductive member 16 on the opening and closing member side slips off the electric circuit 600 that applies a voltage to the secondary transfer roll 411, the voltage application to the secondary transfer roll 411 provided on the printer main body side is immediately stopped. As a result, in the printer 12, when the opening and closing member 10 is opened, the voltage application to the secondary transfer roll 411 is stopped. Since the voltage application is stopped in this way, a situation in which, when the user opens the opening and closing member 10, the user touches the secondary transfer roll 441 to which a voltage is applied is prevented and safety is secured.

In the embodiments explained above, the secondary transfer section 41 is described as an example of the transfer recording device in the present invention. However, the transfer recording device in the present invention only has to be a transfer member that electrostatically transfers a toner image onto a recording medium conveyed on the conveying path to record an image on the recording medium and in which an electrostatic state changes according to opening and closing of the opening and closing member. For example, the transfer recording device may be the primary transfer member that electrostatically transfers an image held on the surface of the photosensitive roll onto the recording medium.

In the embodiments, the color printer of the tandem type is described as an example of the image forming apparatus in the present invention. However, the image forming apparatus in the present invention is not limited to this. For example, the image forming apparatus may be a printer exclusive for monochrome not including the intermediate transfer belt.

In the embodiments, the printer is described as an example of the image forming apparatus in the present invention. However, the image forming apparatus in the present invention is not limited to the printer. For example, the image forming apparatus may be a copying machine or a facsimile that forms an image on the basis of data read by an image reading apparatus.

The conveying apparatus according to the present invention can be applied not only to the image forming apparatus but also to a conveying apparatus in general that detects, with a simple configuration, opening and closing of the opening and closing member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conveying apparatus comprising:

a housing including an opening and closing member that can be opened and closed;

a conveying path that conveys an object to be conveyed, at least a part of the conveying path being provided adjacent to an inner side of the opening and closing member;

a first detector that detects whether the object is present in a predetermined region on the conveying path and outputs a detection signal corresponding to a result of the detection; and an interlocking mechanism comprising a turning guide that causes, when the opening and closing member is opened, the first detector to change at least one of a position and a structure of the first detector in mechanically association with movement of opening of the opening and closing member, and to output a detection signal which is the same as a detection signal output when the object is present in the predetermined region on the conveying path, wherein the first detector comprises:

a light emitting section;

a light receiving section;

a first projecting section that projects to the conveying path; and a second projecting section that enters between or exits from the light emitting section and the light receiving section, and the first projecting section and the second projecting section rotate in the same direction when the first detector detects that the object is present in a predetermined region on the conveying path and that the opening and closing member is opened.

2. The conveying apparatus according to claim 1, further comprising a guide member that is disposed between the conveying path and the opening and closing member, and that guides the object along the conveying path, wherein the interlocking mechanism also causes the guide member to move in a direction away from the conveying path in mechanically association with the movement of opening of the opening and closing member, in addition to causing the first detector to changing the at least one of a position and a structure of the first detector in mechanically association with the movement of opening of the opening and closing member.

3. An image forming apparatus comprising:

a housing including an opening and closing member that can be opened and closed;

a recording device that is disposed in the housing and records an image on a recording medium;

a conveying path that conveys an object to be conveyed, at least a part of the conveying path being provided adjacent to an inner side of the opening and closing member;

a first detector that detects whether the object is present in a predetermined region on the conveying path and outputs a detection signal corresponding to a result of the detection; and an interlocking mechanism comprising a turning guide that causes, when the opening and closing member is opened, the first detector to change at least one of a position and a structure of the first detector in mechanically association with movement of opening of the opening and closing member, and to output a detection signal which is the same as a detection signal output when the object is present in the predetermined region on the conveying path, wherein the first detector comprises:

a light emitting section;

a light receiving section;

a first projecting section that projects to the conveying path; and a second projecting section that enters between or exits from the light emitting section and the light receiving section, and the first projecting section and the second projecting section rotate in the same direction when the first detector detects that the object is present in a predetermined region on the conveying path and that the opening and closing member is opened.

4. The image forming apparatus according to claim 3, further comprising a guide member that is disposed between the conveying path and the opening and closing member, and that guides the object along the conveying path, wherein the interlocking mechanism also causes the guide member to move in a direction away from the conveying path in mechanically association with the movement of opening of the opening and closing member, in addition to causing the first detector to changing the at least one of a position and a structure of the first detector in mechanically association with the movement of opening of the opening and closing member.

5. The image forming apparatus according to claim 3, wherein the recording device is a transfer recording device that electrostatically transfers the image onto the recording medium conveyed on the conveying path to record the image on the recording medium, an electrostatic state of the transfer recording device changing according to opening and closing of the opening and closing member, and wherein the image forming apparatus further comprises a second detector that detects a change of the electrostatic state of the transfer recording device.

6. The image forming apparatus according to claim 5, wherein the transfer recording device includes a first member provided on an opposite side of the opening and closing member across the conveying path and a second member attached to the opening and closing member, and the transfer recording device transfers the image onto the recording medium by forming an electric field between the first member and the second member.

7. The image forming apparatus according to claim 5, wherein the transfer recording device performs the electrostatic transfer of the image, and wherein the image forming apparatus further comprises a breaker that interrupts power to the transfer recording device when the opening and closing member is opened.

* * * * *